United States Patent [19]

Keefe et al.

[11] Patent Number: 4,809,908

[45] Date of Patent: Mar. 7, 1989

[54] CONTAINER WITH INTEGRAL INTERLOCKING COVER

[75] Inventors: Walter D. Keefe, Carol Stream; John A. Pomplin, St. Charles, both of Ill.

[73] Assignee: Container Corporation of America, Clayton, Mo.

[21] Appl. No.: 208,580

[22] Filed: Jun. 20, 1988

[51] Int. Cl.[4] ..... B65D 5/66

[52] U.S. Cl. ..... 229/150; 229/153; 229/160.2

[58] Field of Search ..... 229/149–154, 229/160.2, 186, 190

[56] References Cited

U.S. PATENT DOCUMENTS

| | | | |
|---|---|---|---|
| 992,683 | 5/1911 | Myers | 229/186 |
| 1,111,552 | 9/1914 | Allers | 229/150 |
| 2,544,565 | 3/1951 | Phillips | 229/190 |
| 3,126,142 | 3/1964 | Goetz | 229/151 |
| 3,273,779 | 9/1966 | Mykleby | 229/151 |
| 4,570,845 | 2/1986 | Hall | 229/153 |

FOREIGN PATENT DOCUMENTS

| | | | |
|---|---|---|---|
| 873182 | 6/1971 | Canada | 229/149 |
| 2554034 | 6/1976 | Fed. Rep. of Germany | 229/152 |
| 1270568 | 7/1961 | France | 229/151 |

*Primary Examiner*—Stephen Marcus
*Assistant Examiner*—Gary E. Elkins
*Attorney, Agent, or Firm*—Richard W. Carpenter

[57] ABSTRACT

A container that includes a tray-type body with an integral interlocking cover, wherein the body front and side wall panels are interconnected at the front corners of the container by gussets that present openings for receiving portions of the cover side wall panels to lock the body and cover in a closed position.

11 Claims, 2 Drawing Sheets

CONTAINER WITH INTEGRAL INTERLOCKING COVER

BACKGROUND OF THE INVENTION

1. Field of the Invention:

This invention relates to a paperboard container, and more particularly to a reclosable, tray-type container with an integral, interlocking cover.

2. Description of Background Art:

A background are search directed to the subject matter of this application in the United States Patent and Trademark Office disclosed the following U.S. Pat. Nos. 665,556, 992,683, 1,003,150, 1,189,452, 2,174,179, 3,095,137, 3,126,142, 4,136,816, 4,570,845.

None of the patents uncovered in the search discloses a container including a tray-type body with an integral cover, wherein the body front and side wall panels are foldably joined to each other at the front corners of the container by gusset members that present openings for receiving locking projections extending from the cover side wall panels to lock the body and cover in a closed position.

SUMMARY OF THE INVENTION

It is an object of the present invention to provide an improved, reclosable, container having a tray-type body and an integral interlocking cover.

It is a more specific object of the invention to provide, in a container of the type described, an interlocking arrangement for the body and cover members of the container wherein the body member presents, at the front corners of the tray, gussets having openings for receiving projections extending from the side wall panels of the cover member.

These and other objects of the invention will be apparent from an examination of the following description and drawings.

Figure 1:
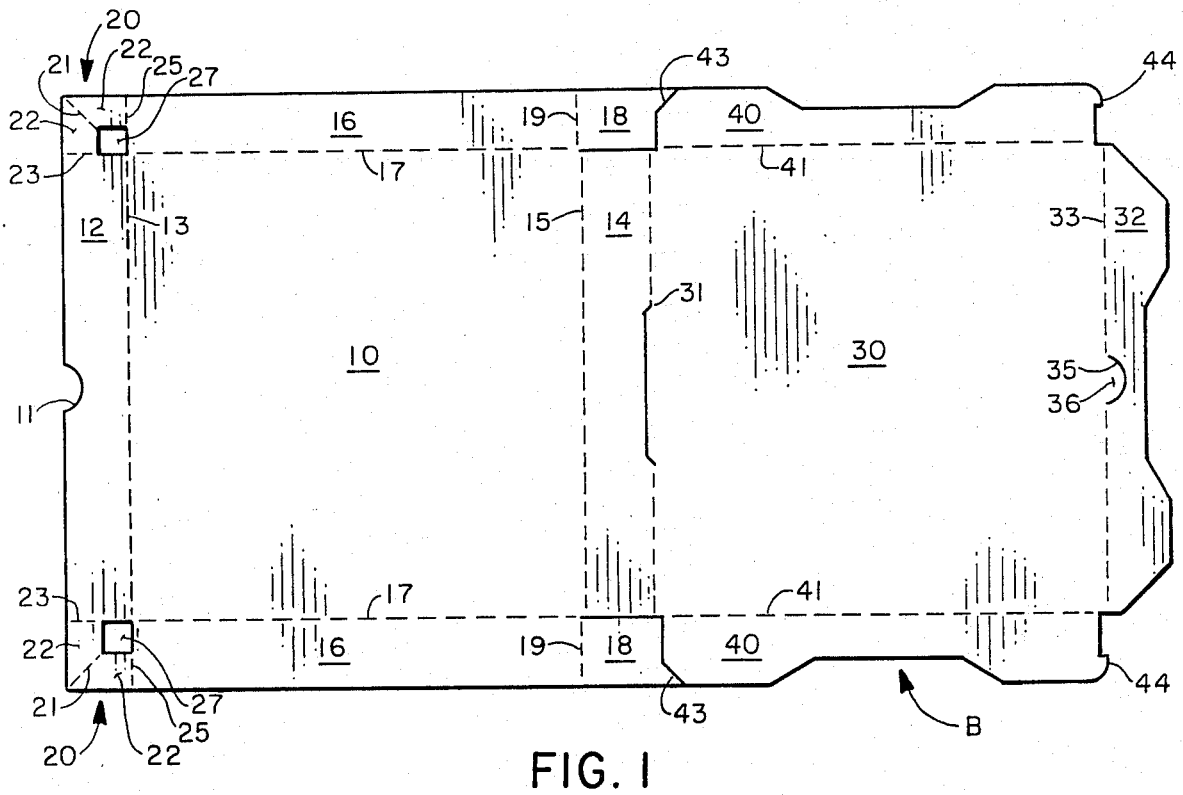
FIG. 1 is a top plan view of a blank of a foldable sheet material from which the container illustrated in the other views may be formed.

It will be understood that, for purposes of clarity, certain elements may have been intentionally omitted from certain views where they are illustrated to better advantage in other views.

DESCRIPTION OF THE PREFERRED EMBODIMENT

Referring now to the drawings for better understanding of the invention, it will be seen that the container, indicated generally at K, includes a tray-type body, indicated generally at T, and an integral cover, indicated generally at C, that are hingedly connected to each other and adapted for interlocking reclosure.

Container K may be formed from a unitary blank B of foldable sheet material, such as paperboard, illustrated in FIG. 1 of the drawings.

The body T includes a generally rectangular bottom wall panel 10 having a pair of upstanding front and rear wall panels 12 and 14 foldably joined to its front and rear edges along fold lines 13 and 15, respectively, and a pair of upstanding side wall panels 16, foldably joined to its opposite side edges along fold lines 17.

A pair of rear corner flaps 18 are foldably joined to the rear edges of respective side wall panels 16 along fold lines 19, which are aligned with previously mentioned fold line 15.

At the forward portion of the body, each end of the front wall panel 12 is foldably connected to one of the side wall panels 16 by means of a gusset, indicated generally at 20. Each of the gussets 20 includes a pair of generally triangular gusset sections 22 which are foldably joined to each other along a diagonal fold line 21, with one of the gusset sections being foldably joined to an adjacent end of the front wall panel 12, along a fold line 23, and the other gusset section being joined to a related end wall panel 12, along a fold line 23.

It will be noted that each of the gussets 20 has at an inner corner, adjacent bottom wall panel 10, an opening 27, the purpose of which is described later in the specification.

Figure 2:
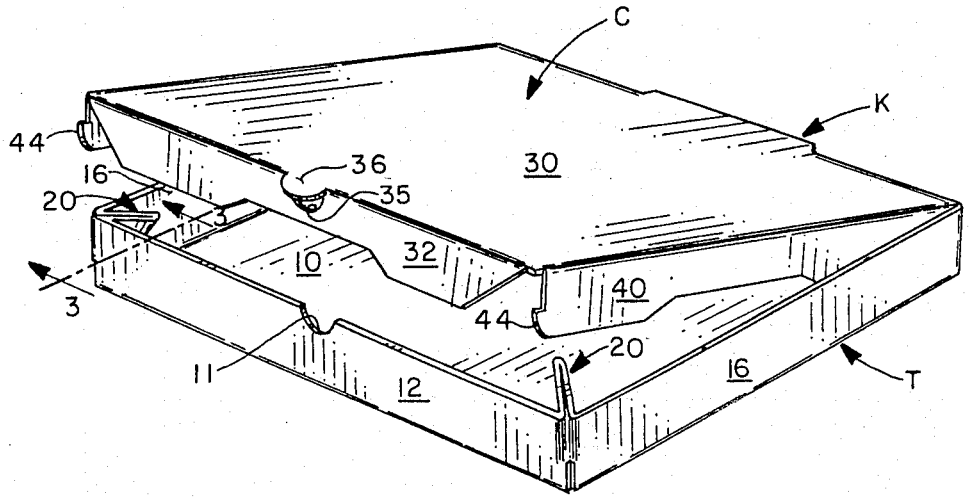
FIG. 2 is a fragmentary perspective view of a container embodying features of the present invention, as shown in an open position.

Still referring to FIGS. 1 and 2, it will be seen that the cover C of the container includes a generally rectangular top wall panel 30 that is hingedly connected at its rear edge, along a combination cut and score line 31, to the upper edge of body rear wall panel 14.

Cover top wall panel 30 has a depending front wall panel 32 foldably joined along fold line 33 to its front edge and a pair of depending side wall panels 40 foldably joined along fold lines 41 to its opposite side edges. The adjacent ends of cover top and side wall panels are free from direct connection to each other.

Figure 3:
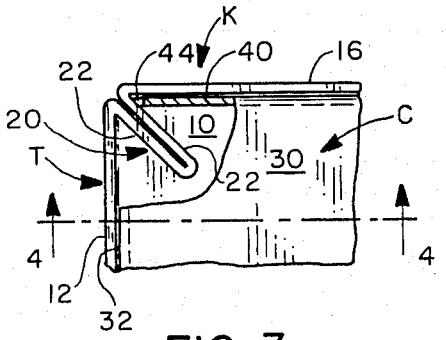
FIG. 3 is a fragmentary sectional view taken on line 3—3 of FIG. 2.

In forming the carton, the body front and side walls are folded upwardly at right angles to the bottom wall panel 10, to form a box-like structure, with the gussets 22 projecting inwardly into the container, as illustrated in FIGS. 2 and 3.

Figure 4:
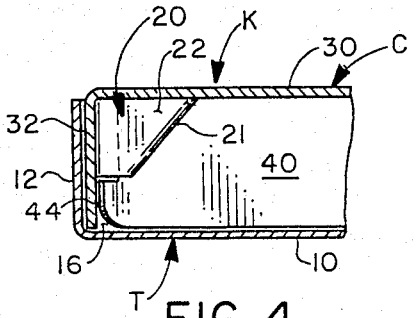
FIG. 4 is a fragmentary sectional view taken on line 4—4 of FIG. 3.
Figure 5:
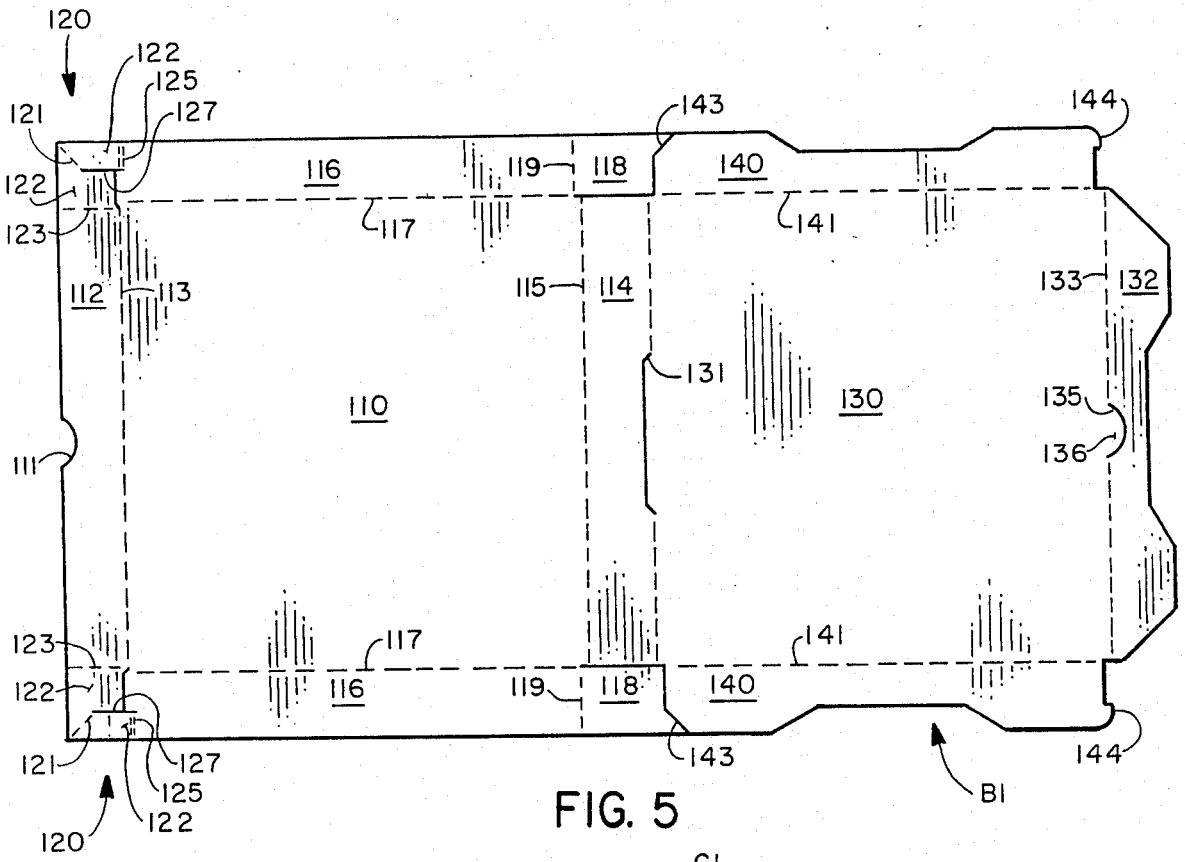
FIGS. 5–8 are views similar to those of FIGS. 1–4 respectively, but illustrate a modified form of the invention.
Figure 6:
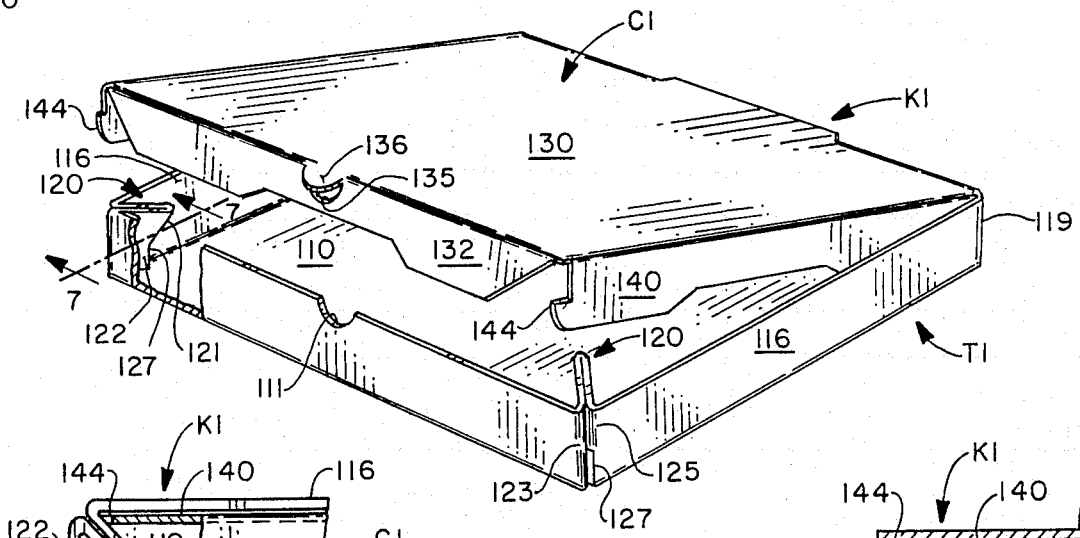
Figure 7:
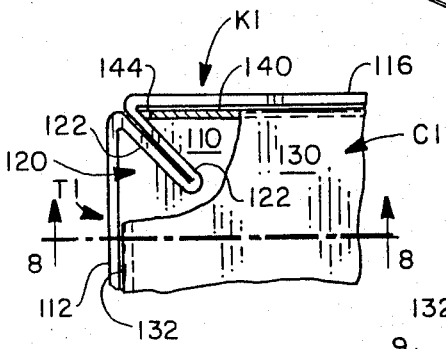

Also, the cover front and side wall panels are folded at right angles to the top wall panel to form a box-like cover structure that is inserted into the body, as seen in FIGS. 2–4.

It will be seen that the body member front wall 12 is provdied with a finger opening 11 adjacent the upper edge thereof which opening is adapted to align with a related finger opening 35 in the cover front wall panel. The opening 35 in the cover front wall panel is formed when material is cut from the front wall panel to form a lift tab 36 that projects forwardly from the front edge of cover top wall panel 30.

The essential feature of the present invention resides in the novel interlocking arrangement between the container body and cover. Each of the cover side wall panels 40 has an integral projection or abutment 44 extending forwardly from a lower portion of its front end edge. The purpose of these projections is to provide an interlocking connection between the container body and the cover when the cover projections are received within the related openings below the body gussets, as best seen in FIGS. 3 and 4.

To open the container, one merely engages the lift tab 36 and forces the cover upwardly from the body. In order to close and relock the container, the cover is pushed down with the front and side wall panels of the cover positioned inside of the front and side wall panels of the body until the projections 44 are engaged under the gussets 22, as best seen in FIG. 4.

Turning now to FIGS. 5–9, it will be seen that a slightly modified form of the invention is shown.

In these views portions of the structure that correspond to portions of the structure illustrated in the previous views have been identified by related numerals.

The only difference in the structure of the embodiment of FIGS. 5–9 lies in the construction of gusset 120. Instead of cutting a hole through the gusset to provide an opening in the corner of the gusset, as in the previous embodiment, the effect of the opening is created in a slightly different way. In this embodiment, the fold lines 121 and 125 each extend only about half way into the gusset, and their inboard edges are connected to each other by an L-shaped cut line 127 that extends from the inboard end of fold line 121 to the inboard end of fold line 125, and then to the outer corner of bottom wall panel 110.

Figure 8:
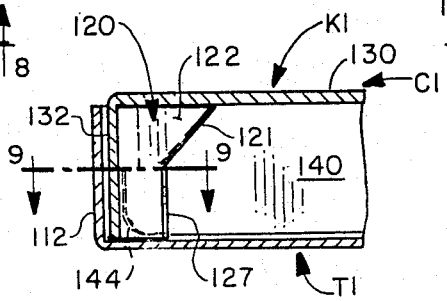
Figure 9:
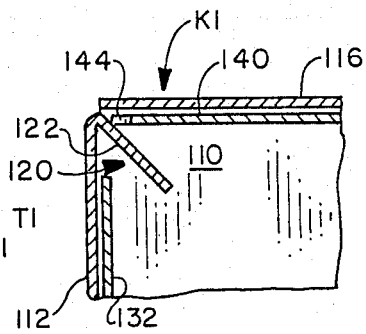
FIG. 9 is a fragmentary sectional view taken from line 9—9 of FIG. 8.

When the body is erected, as seen in FIGS. 6–9, an opening is formed at the bottom of the gusset section 122 that is joined to related side wall panel 116, so when the cover is moved to the closed position of FIGS. 8 and 9, the projection 144 will be locked under the gusset 120 in the same manner as in the previous embodiment.

Thus, it should be appreciated that the invention affords a simple, yet effective, arrangement for providing a positive interlocking connection between the integral body and cover portions of a one-piece, reclosable, paperboard container.

What is claimed is:

1. A reclosable, self-locking container formed from a unitary blank of foldable sheet material, such as paperboard, and comprising:

(a) a tray type body including a generally rectangular bottom wall panel having front and rear wall panels and opposed side wall panels foldably joined to and upstanding from front, rear, and side edges thereof and having corner flaps foldably joined to rear edges of said side wall panels and folded inwardly therefrom and normal thereto;

(b) a cover including a generally rectangular top wall panel foldably joined at its rear edge to an upper edge of said body rear wall panel and having a front wall panel and opposed side wall panels foldably joined to and depending from front and side edges thereof with said cover front and side wall panels being free from direct connection to each other;

(c) each of said cover side wall panels having a locking projection extending forwardly a slight distance beyond a front edge thereof and immediately above a lower edge thereof;

(d) said body front wall panel being joined at each side edge to a front edge of an adjacent body side wall panel by a gusset adapted for interlocking engagement with a related cover side wall panel locking projection to lock said body and cover in closed position when said cover front and side wall panels are positioned within said body front and side wall panels and said body corner flaps are positioned between an inner surface of said body rear wall panel and a rear surface of a related cover side wall panel.

2. A reclosable, self-locking container formed from a unitary blank of foldable sheet material, such as paperboard, and comprising:

(a) a tray type body including a generally rectangular bottom wall panel having front and rear wall panels and opposed side wall panels foldably joined to an upstanding from front, rear, and side edges thereof;

(b) a cover including a generally rectangular top wall panel foldably joined at its rear edge to an upper edge of said body rear wall panel and having a front wall panel and opposed side wall panels foldably joined to and depending from front and side edges thereof;

(c) each of said cover side wall panels having a locking projection extending forwardly a slight distance beyond a front edge thereof and immediately above a lower edge thereof;

(d) said body front wall panel being joined at each side edge to a front edge of an adjacent body side wall panel by a gusset adapted for interlocking engagement with a related cover side wall panel locking projection to lock said body and cover in closed position when said cover front and side wall panels are positioned within said body front and side wall panels.

3. A unitary blank of foldable sheet material, such as paperboard, for use in forming a reclosable, self-locking container, said blank being cut and scored to provide:

(a) a generally rectangular body bottom wall panel;

(b) body front and rear wall panels foldably joined to front and rear end edges of said bottom wall panel;

(c) body side wall panels foldably joined to opposite side edges of said bottom wall panel;

(d) said body front wall panel being foldably joined to said body side wall panels at corresponding corners of the blank by gussets, each of which includes:

(i) a pair of generally triangular sections foldably joined to each other and to adjacent side and end edges of said body front wall panel and a related body side wall panel respectively;

(ii) said gussets having portions cut to form a common locking projection receiving opening at an inboard corner of said gusset adjacent said bottom wall panel.

(e) corner flaps foldably joined to other end edges of said body side wall panels remote from said gussets;

(f) a cover top wall panel foldably joined at one end edge to an adjacent edge of said body rear wall panel;

(g) a cover front wall panel foldably joined to another end edge of said top wall panel;

(h) cover side wall panels foldably joined to opposite side edges of said top wall panel;

(i) said cover side wall panels each presenting a locking projection extending outwardly beyond a free end edge thereof at a corner of the blank remote from one of said gussets.

4. A container according to claim 1, wherein said body and cover front wall panels have aligned finger openings extending therethrough adjacent upper edges thereof.

5. A container according to claim 2, wherein said body and cover front wall panels have aligned finger openings extending therethrough adjacent upper edges thereof.

6. A container according to claim 4, wherein said cover top wall panel has an integral lift tap projecting forwardly therefrom immediately above its finger opening.

7. A container according to claim 5, wherein said cover top wall panel has an integral lift tab projecting forwardly therefrom immediately above its finger opening.

8. A blank according to claim 3, wherein said body front wall panel has a finger opening disposed adjacent a free edge thereof.

9. A blank according to claim 8, wherein said cover front wall panel has an arcuate cut therein that defines a lift tab and a finger opening.

10. A blank according to claim 3, wherein each of said gussets have an opening extending therethrough adjacent said body bottom wall panel.

11. A blank according to claim 3, wherein each of said gussets includes a pair of spaced, angularly related fold lines interconnected by a generally L-shaped cut line extending between inboard ends of said cut lines and a related corner of said body bottom wall panel.

* * * * *